US005516627A

United States Patent [19]

Marui

[11] Patent Number: 5,516,627

[45] Date of Patent: May 14, 1996

[54] METHOD OF PROCESSING SILVER HALIDE LIGHT-SENSITIVE PHOTOGRAPHIC MATERIAL

[75] Inventor: Toshiyuki Marui, Hino, Japan

[73] Assignee: Konica Corporation, Japan

[21] Appl. No.: 393,456

[22] Filed: Feb. 23, 1995

[30] Foreign Application Priority Data

Feb. 28, 1994 [JP] Japan ..... 6-030141

[51] Int. Cl.[6] ..... G03C 5/29; G03C 5/38

[52] U.S. Cl. ..... 430/350; 430/403; 430/432; 430/631; 430/950; 430/961

[58] Field of Search ..... 430/350, 403, 430/963, 432, 950, 631

[56] References Cited

U.S. PATENT DOCUMENTS

| | | | |
|---|---|---|---|
| H674 | 9/1989 | Nagasaki et al. | 430/963 |
| 5,217,853 | 6/1993 | Yamada et al. | 430/963 |
| 5,230,994 | 7/1993 | Yamada et al. | 430/963 |

FOREIGN PATENT DOCUMENTS

| | | |
|---|---|---|
| 267019 | 5/1988 | European Pat. Off. . |
| 528476 | 2/1993 | European Pat. Off. . |
| 226638 | 9/1988 | Japan . |
| 295846 | 10/1992 | Japan . |
| 340951 | 11/1992 | Japan . |
| 53237 | 3/1993 | Japan . |
| 61147 | 3/1993 | Japan . |
| 53230 | 3/1993 | Japan . |
| 173279 | 7/1993 | Japan . |

*Primary Examiner*—Richard L. Schilling
*Attorney, Agent, or Firm*—Jordan B. Bierman; Bierman and Muserlian

[57] ABSTRACT

A method for processing a silver halide photographic material. The method comprises the steps of (1) developing, fixing and washing a photographic light-sensitive material which comprises a support and a photographic layer including a silver halide emulsion layer being provided on the support in which the outermost surface of the photographic layer has a matting degree of 0 to 150 mmHg and the silver halide emulsion layer contains colloidal silica particles, (2) drying the silver halide photographic light-sensitive material by contacting with a heat conductive member having a surface temperature of 90° C. to 150° C. which installed in a drying zone of the automatic processing machine. In the above method, the photographic light-sensitive material has a moisture content of 3 g/m$^2$ to 6.5 g/m$^2$ at the point just before of the drying zone and the total time from start of the developing process to finish of the drying process is within the range of more than 15 seconds to less than 45 seconds.

6 Claims, 1 Drawing Sheet

METHOD OF PROCESSING SILVER HALIDE LIGHT-SENSITIVE PHOTOGRAPHIC MATERIAL

FIELD OF THE INVENTION

The present invention relates to a method for processing a silver halide light-sensitive photographic material, particularly relates to a method for processing a high-speed silver halide photographic material without occurrence of roller marks, reflective spots and uneven development.

BACKGROUND OF THE INVENTION

Recently, accompanied with the development of photographic technique, there is a strong demand for high sensitive silver halide light-sensitive photographic materials which are capable of producing photographic images of high image quality. Further, there is also a strong demand for rapid processing to obtain a processed image for shortened time.

Various techniques have been proposed for making rapid processing of the light-sensitive materials. For instance, a technique in which the amount of binder or swelling degree of a layer of a photographic material is reduced. As a result this, the moisture content of a photographic material after processing thereof is reduced and the drying time can be shortened. However, the reducing in the amount of the binder causes weakening in the physical properties of the layer even though the moisture content thereof is lowered. The lowering in the physical properties of the photographic layer is accompanied by formation of fogging due to friction of rollers in a processor, which is so-called "roller marks" or a problem of uneven development.

On the processor side, processors having a drying zone in which a heat transfer member or a heat-irradiating member are installed in order to raise dry efficiently in a short time. But, there has been a problem that reflection spots are often took place on the processed film surface when a photographic material in which the moisture content or the degree of swell is decreased, is processed by the processor mentioned as above.

Herein the term "reflection spot" denotes uneven drying accompanying uneven glossiness on the surface of dried photographic material.

As a method for preventing reflective spot unevenness of a light-sensitive material whose moisture content immediately before the drying zone is 6.5 g/m$^2$, Japanese Patent Open to Public Inspection (hereinafter, referred to as Japanese Patent O.P.I. Publication) No. 173279/1993 discloses a technology to incorporate a polyhydroxybenzene compound in a silver halide photographic light-sensitive material constituting layer. However, aforesaid technology could not prevent reflective spot unevenness completely.

Japanese Patent O.P.I. Publication No. 226638/1988 discloses a silver halide photographic light-sensitive material processed in 20 to 60 seconds wherein the amount of gelatin is 2.10 to 3.30 g/m$^2$ and matting degree is 40 to 150 mmHg so that improvements in terms of sensitivity in rapid processing, drying property, scratch blackening, sticking and matting pressure fogging have been achieved.

Japanese Patent O.P.I. Publication No. 295846/1992 discloses a silver halide photographic light-sensitive material processed in 15 to 60 seconds wherein silver halide grains contain an iron compound, aforesaid emulsion layer contains colloidal silica and the amount of gelatin in a protective layer is 0.5 g/m$^2$ or less so that anti-pressure property has been improved.

Japanese Patent O.P.I. Publication No. 340951/1992 discloses a silver halide photographic light-sensitive material processed in 15 to 60 seconds wherein silver halide grains subjected to selenium sensitization and colloidal silica are contained so that sensitivity and anti-pressure property in high illumination and short time exposure have been improved.

Japanese Patent O.P.I. Publication No. 61147/1993 discloses a silver halide photographic light-sensitive material processed in 15 to 60 seconds wherein silver halide grains subjected to tellurium sensitization and colloidal silica are contained so that sensitivity and anti-pressure property in high intensity and short time exposure have been improved.

Japanese Patent O.P.I. Publication No. 53230/1993 discloses a light-sensitive material containing an emulsion composed of a tabular grain whose aspect ratio is 3 or higher wherein the average iodide content in the total grains is 0.6 mol or lower and colloidal silica. Here, sensitivity and pressure characteristics have been improved.

Japanese Patent O.P.I. Publication No. 53237/1993 discloses a silver halide photographic light-sensitive material having 2 or more light-sensitive silver halide emulsion layers wherein a layer which is the farthest from a support contains colloidal silica and the other layers do not substantially contain colloidal silica. Here, scratch blackening has been improved.

However, the above-mentioned technologies are not satisfactory in terms of rubbing-type roller mark and streaks in super rapid processing of less than 45 seconds. Especially, these technologies are not satisfactory in terms of reflective spot unevenness in a drier apparatus using a heat transfer object.

SUMMARY OF THE INVENTION

The object of the present invention is to provide a method for rapidly processing a silver halide light-sensitive photographic material without generating frictional roller marks and causing reflection spot formation and uneven development.

The method of the invention is a method for processing a silver halide photographic light-sensitive material with an automatic processing machine comprising the steps of developing, fixing and washing a photographic light-sensitive material which comprises a support and a photographic layer including a silver halide emulsion layer being provided on the support in which the outermost surface of the photographic layer has a matting degree of 0 to 150 mnHg and the silver halide emulsion layer contains colloidal silica particles, drying the silver halid ephotogrpahic light-sensitive material by contacting with a heat conductive member having a surface temperature of 90° C. to 150° C. which installed in a drying zone of the autmatic processing machine, wherein the photographic light-sensitive material has a moisture content of 3 g/m$^2$ to 6.5 g/m$^2$ at the point just before of the drying zone and the total time from start of the developing process to finish of the drying process is within the range of more than 15 seconds to less than 45 seconds.

DETAILED DESCRIPTION OF THE INVENTION

Figure 1:
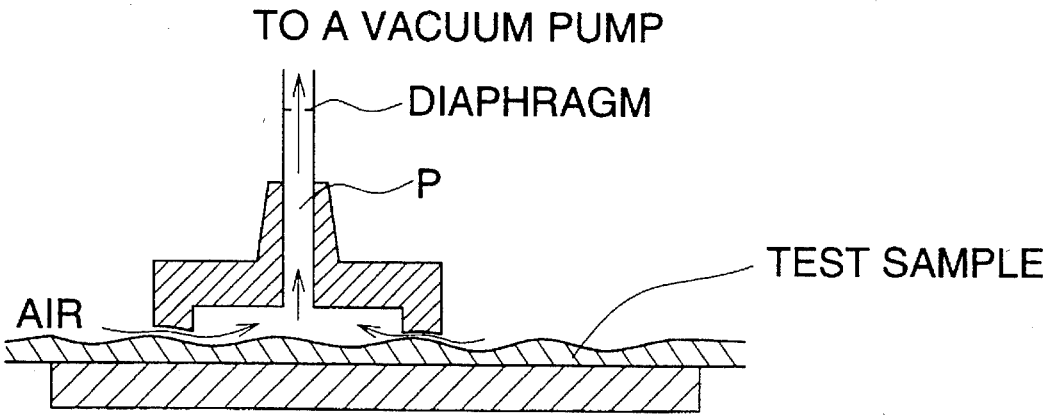
FIG. 1 is a schematic drawing of a appartus for measuring matting degree.

The matting degree of the surface in the emulsion layer side in the present invention is 150 mmHg not more than.

The matting degree mentioned here represents the roughness of the surface of the film. It can be measured by the following method.

In this specification, the matting degree is defined as a value of suction pressure represented by mmHg measured under a constant condition with respect to a unexposed and not processed photographic material (so-called a raw film) sample which is conditioned for 4 hours at 23° C. and 48% HR. The matting degree is evaluated with the aid of SMOOSTER, manufactured by Toei Denshi Kogyo K. K.. Thus, utilizing a vacuum type air micrometer, a flow rate of air variable depending upon smoothness of the surface is measured as a change of pressure. The matting degree is defined as a pressure value expressed in mmHg. The larger is the value, the greater the matting degree. When measuring the matting degree, the sample to be tested is placed beneath a head shown in FIG. 1. When a vacuum pump sucks out air inside a tube through a diaphragm having a prescribed aperture area, the pressure inside the tube P (mmHg) is read off.

To give a matting degree to a light-sensitive material, a matting agent is generally used. In general, the matting agent is a fine particle of water-insoluble organic or inorganic compound. In the present invention, arbitrary one which is known well in the field of this industry can be used. As an organic matting agent, ones described in, for example, U.S. Pat. Nos. 1,939,213, 2,332,037, 2.701,245, 3,262,782, 3,539,344 and 3,767,488 can be used.

As an inorganic matting agent, ones described in U.S. Pat. Nos. 1,260,772, 2,192,241, 3,257,206, 3,370,951, Nos. 3,523,022 and 3,769,020 can be used.

Examples of preferably usable organic compound which can be specifically used as matting agent include water-dispersed vinyl polymers such as polymethyl acrylate, polymethyl metaacrylate, polyacrylonitrile, acrylonitrile-α-methylstyrene copolymer, polystyrene, styrene-divinylbenzene copolymer, polyvinyl acetate, polyethylene carbonate and polytetrafluoro-ethylene; cellulose derivatives such as methyl cellulose, ethyl cellulose, cellulose acetate and cellulose acetate-propionate; starch derivatives such as carboxylated starch, carboxynitrilophenylated starch and reaction products of urea, aldehyde and starch; Gelatin hardened with a well-known hardener and hardened gelatin in a form of fine empty capsule prepared by a coacervation hardening method. As inorganic compounds, silica dioxide, titanium dioxide. magnesium dioxide, aluminum oxide, barium sulfate, calcium carbonate, silver chloride and silver bromide each desensitized by a known method, glass beads and diatomaceous earth can preferably be used.

The above-mentioned matting agent can be used either singly or two or more kinds in combination depending on the situation.

There is no specific limitation in the size and the shape of the matting agent. The one having an arbitrary particle size can be used. It is preferable to use the one having a particle size of 0.1–15 microns in an embodiment of the invention.

The matting agent used may be either one having narrow or wide particle size distribution and may be either one polydispersed or monodispersed. A monodispersed matting agent in here is defined as in which number of particles having each having a size within the range of ±20% of average particle occupies 90% or more of the whole number of the particles.

In the present invention, the matting degree of the emulsion coated side is preferably 0 to 150 mmHg, more preferably 0 to 100 mmHg and particularly preferably 0 to 70 mmHg. Although, the effects of the processing method of the invention can be enhanced in the above region of the matting degree, it is preferable that the lower limit of the matting degree of a photographic material is 10 mmHg or more, more preferable 20 mmHg or more, for preventing adhesion between photographic materals and occurrance of static marks caused by handling the photogrpahic material.

When emulsion layer is provided only on one side of the support, it is preferable that the matting degree of the emulsion layer side is lower than that of the backing layer. In this case, the difference of the matting degree may be 50 mmHg or less.

The value of the matting degree in the above-mentioned emulsion layer side and the backing layer side can be adjusted properly by varying kind grain size or amount of the matting agent used.

Ordinarily, in the case of the same amount added, the larger the average grain size of matting agent becomes, the higher the matting degree becomes. When comparing in the case of the same grain size, the larger the amount added is, the higher the matting degree becomes. In an embodiment of the present invention, when a matting agent whose average grain size is 0.1 to 15 μm is used, the ordinary range is 1 to 500 mg per $m^2$ on one side and the especially preferable range is 5 to 100 mg.

In the present invention, it is preferable that the matting agent is incorporated in the outermost layer or a layer which functions as the external surface layer of the photographic material or a layer provided near the external surface layer. It is preferable to be incorporated in the layer which functions as a so-called protective layer. Namely, it is preferable to be incorporated in a non-light-sensitive protective layer on the emulsion-coated side.

As heat transferring member usable in the present invention, a heat roller can be given as a typical example. The heating roller is preferably one comprised of a hollow aluminum roller covered with silicon rubber, polyurethane or Teflon. It is preferable that both ends of this heating roller is pivottaly supported on the side walls near the entrance of drying zone with bearings made by heat-resistive resin such as Rulone (trade name) so as to freely rotate.

A gear is fixed at one end of the heat roller, and it is preferably rotated in the direction of transportation by a driver means and a transmission means thereof. Inside the heat roller a halogen heater is inserted, and this halogen heater is preferably connected with a temperature controller provided in the processor.

The temperature controller is connected with a thermistor which is arranged in contact with the outer surface of the heat roller so as to turn on/off the halogen heater by a signal from the thermistor. The thermistor is preferably connected with a temperature controller provided in the process. The temperature controller is preferably set so that the detection temperature from thermistor to be 90°–150° C., more preferably to be 90°–130° C.

The heat rollers are arranged so as to directly touch a photographic material to be transported and dried in the drying zone. For example, the heat rollers may be agganged so as to make one or more paires and to transport the photographic material by holding it between the paired rollers, or may be staggeringly agganged conveniently for transfering the photographic material.

The heat roll ma be used in combination together with a non-touching drying means using a heat emitting member such as infra-red heater or a heated air blower. The combination with the heated air blower is particularly preferable.

In the method of the invention, preferable time for drying process is 3 to 10 seconds, more preferably 3 to 8 seconds.

As for the average diameter of the colloidal silica to be incorporated in the silver halide emulsion layer in the present invention, 5–5000 nm and, especially, between 10 and 1000 nm is preferable. The main ingredient of the colloidal silica consists of silicon dioxide and it may contain a small amount of alumina, or aluminate, such as sodium aluminate, potassium aluminate.

These colloidal silica may further contain an inorganic or organic salt such as sodium hydroxide, potassium hydroxide, lithium hydroxide, ammonium hydroxide, tetramethyl ammonium ion as a stabilizing agent.

Colloidal silica may be available in the market with trade names of Ludox AM, Ludox AS, Ludox LS, Ludox TM, and Ludox HS, produced by E.I.Du Pont de Nemours & Co.(USA); Snowtex-20, Snowtex-30, Snowtex-C, and Snowtex-O, produced by Nissan Chemical Industries Co; Syton C-30 and Syton ZOO produced by Monsanto Co.(USA); Nalcoag-1060 and Nalcoag-ID 21–64, produced by Nalco Chem Co..

Amount of use of the above-mentioned colloidal silica to be added to the silver halide emulsion of the present invention, it is generally 0.01 to 2.0, more preferably 0.1 to 1.0 in the weight ratio of colloidal silica to gelatin used in the emulsion layer. The colloidal silica may be added to an emulsion in a state of diluted properly with water or a hydrophilic solvent. Although, there is no special limitation as to the time of addition of the colloidal silica to the emulsion, it preferably be during the time between the end of chemical ripening and coating. Addition of the colloidal silica to the emulsion can be made either singly or together with other additives.

When a photographic material has two or more silver halide emulsion layers. The plural silver halide emulsion layers can be provided on the same side or provided separately from each other on the both sides of the support. The colloidal silica can be incorporated into these plural layers or into some of these layers. When it is incorporated in a part of the silver halide emulsion layer, it is preferable to incorporate in the emulsion layer which is farthest from the support.

In the method of the invention, the silver halide light-sensitive photographic material is processed spending a time of 45 seconds or less in total, dry to dry, in a processor which has a drying zone, in which the photographic material is dried using a heat conductive member heated sa as to become the temperature of surface thereof to not lower than 90° C.

In the present invention, the term "immediately prior to the drying zone" means a position at which a silver halide light-sensitive photographic material has passed through squeezing rollers after processes in the developing and fixing baths and washing are completed.

The moisture content of a photographic material immediately before the drying zone is determined by a weighing method as follows. An unexposed sample cut in a size of 10×12 inches insert into an automatic processor. The sample is take out just after the squeezinf roll of the processor and is weighed within 60 seconds in an atmosphere of 25° C. and 55% RH to determine the weight of the sample W1. Then the sample is satisfactorily dried and is eighed after standing for at least 1 hour under acondition of 25° C. and 55% RH to determined the weight of the dried sample W2. When the same layers are proveided on both sides of the support of the sample, the moisture content is calcurated by converting a value calculated by an equation of (W1−W2)/2 to the weight in terms of per square meter. When the photographic material to be determined has layers different from each other on different sides of the support, two samples each having one of these layers are aprepared and the value of (W1−W2) are measured, respectively. Thus measured value are converted to weight in terms of per square meter.

In the pesent invention, the moisture content immediately before a drying zone is preferably not more than 6.5g/m$^2$, more preferably 3 to 6.5 g/m$^2$, further preferably 4 to 6 g/m$^2$, for each side.

In order to reduce the moisture content immediately before entering the drying zone to 6.5 g/m$^2$ or less per one side of a photographic material, the amount of gelatin in a light-sensitive material, the degree of swelling after washing processing and the amount of squeezing must be controlled. The smaller the amount of gelatin in the light-sensitive material, the more aforesaid moisture amount can be reduced. However, this method is liable to cause deterioration in terms of pressure durability and roller mark. The amount of a binder such as gelatin in the light-sensitive material in the invention is preferabley 2 to 3.6 g/m$^2$, more preferably 2.5 to 3.2 g/m$^2$, for one side of the light-sensitive material. The swelling degree after washing processing is swelling degree after a developing step, a fixing step and a washing step. By reducing swelling in each step, the moisture content immediately before the drying zone can be reduced. The lower the temperature, the smaller the swelling degree in each step. However, when temperature is lower, processing speed in each step, i.e., developing speed, fixing speed and washing speed, is lowered. Therefore, this method is not suitable for rapid processing. In addition, by hardening the gelatin in the light-sensitive material during processing steps, swelling degree can be reduced. A method to add a hardener such as glutaric aldehyde to a developing solution and a method to add aluminum compounds to a fixing solution are well-known methods.

In addition, by hardening a light-sensitive material sufficiently, aforesaid moisture content can be reduced. In addition, there are other methods for reducing aforesaid moisture content including a method to use a soft material such as silicone rubber or a moisture-absorptive material for a squeeze roller, a method to enhance squeezing pressure oa a pair of the squeeze rollers and a method to increase the number of the squeeze rollers. In the present invention, the above-mentioned methods can be arbitrarily mixed so that aforesaid moisture amount per one side can be reduced to 6.5 g/m$^2$ or less. The preferable method is to regulate the moisture content by means of controlling the amount of hardener of the light-sensitive material.

A hardener can be selected arbitrarily from those described in RD 17643, RD 18716 and RD 308119 described later. The preferable is a vinylsulfon type described in Japanese Patent Publication No. 13563/1974 and a carbamoyl ammonium type described in Japanese Patent O.P.I. Publication Nos. 51945/1974 and 59625/1976. The especially preferable is a carbamoyl ammonium compound represented by the following Formula I.

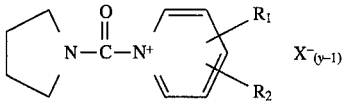

Formula 1 wherein $R_1$ is a substituted or unsubstituted alkyl group or substituted or usubstituted alkoxyl group; $R_2$ is a substituted or unsubstituted alkyl group, a substituted or unsubstituted acyl group or a substituted or unsubstituted acylamino group; $X^-$ is an anion which may be form a intramolecular salt; and y is 1 or2.

In the above Formula 1, $R_2$ is preferably an alkylsulfonic acid group or an acylamino group.

It is further preferable, in Formula 1, that $R_2$ is $—(CH_2)_m—SO_3^-$, $—NR_3COR_4$, $—(CH_2)_p—CON_7R_{10}$ or $—(CH_2)_s—CH_2—(LR_{11})—R_{12}$, in which $R_3$ is a hydrogen atom, a substituted or unsubstituted alkyl group, an alkoxyl group, $—O—(CH_2)_n—SO_3^-$, $—NR_5R_6$ or $—(CH_2)_n—SO_3—$; $R_4$ is a substituted or unsubstituted alkyl group, an alkoxyl · grop, $—O—(CH_2)_n—SO_3^-$, $—NR_5R_6$ or $—(CH_2)_n—SO_3^-$; $R_5$ and $R_6$ are each a hydrogen atom, an alkyl group or $—(CH_2)_n—SO_3^-$; $R_7$ is a hydrogen atom, an alkyl group or a aryl group; $R_8$ is is a hydrogen atom, an alkyl gtroup or a group necessary to form a five- or six-member ring together with a group represented by $R_7$; $R_9$ is a hydrogen atom, an alkyl group or $—COR_4$; $R_{10}$ is a hydrogen atom, an alkyl group or $—(CH_2)_r—SO_3^-$; L is —O— or $—NR_{13}—$; $R_{11}$ is a hydrogen atom or an alkyl group; $R_{12}$ is a hydrogen atom, an alkyl group, $—COR_{14}$ or $—CONHR_{15}$; $R_{13}$, $R_{14}$ and $R_{15}$ are each a hydrogen atom or an alkyl group; m is 0, 2, 3 or 4; n is 1, 2 or 3; p is 0, 1 or 2; and q and r are each 1, 2 or 3.

Among the above, it is more preferably that $R_1$ is as hydrogen atom, an alkyl group or an alkoxyl group; and $R_2$ is $—(CH_2)_m—SO_3^-$ or $—NR_3COR_4$.

The followings are examples of compounds represented by formula I.

(1)

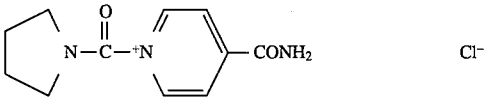

(2)

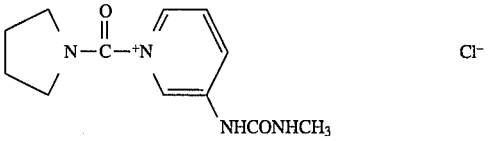

(3)

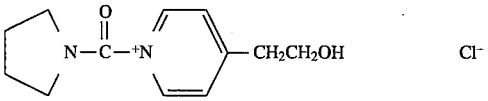

(4)

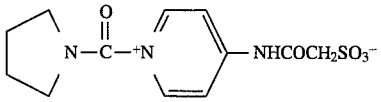

(5)

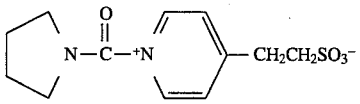

(6)

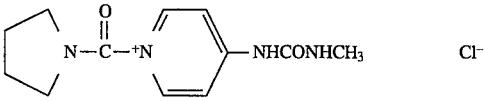

-continued (7)

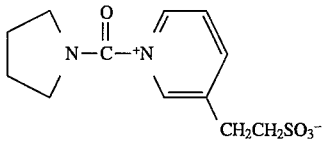

(8)

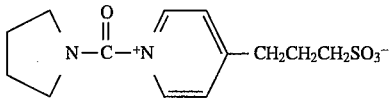

(9)

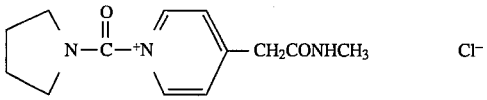

(10)

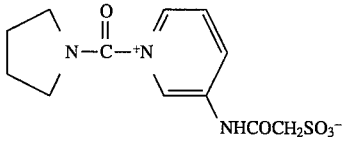

(11)

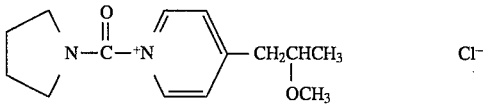

(12)

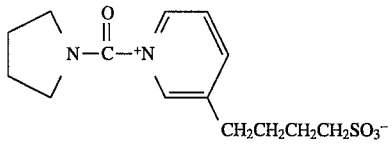

(13)

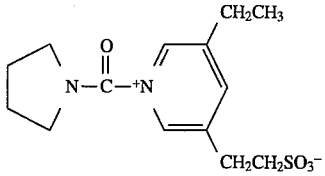

(14)

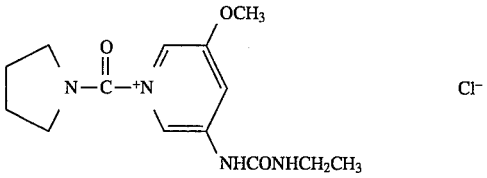

(15)

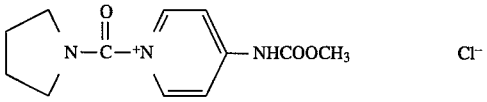

(16)

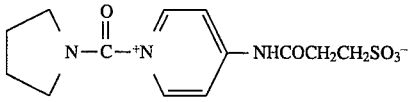

(17)

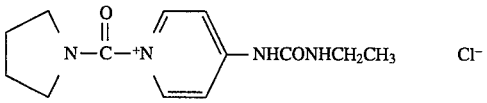

(18)

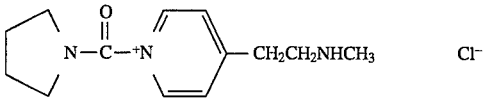

-continued

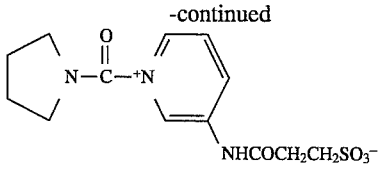

(19)

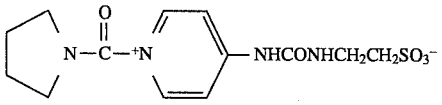

(20)

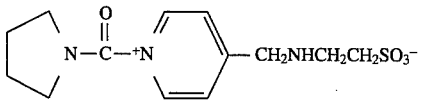

(21)

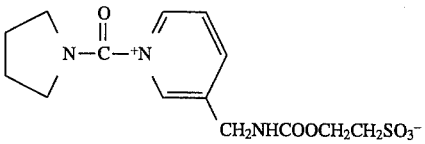

(22)

These compounds can be easily synthesized by a method described in known literatures, for instance, Chem. Ber. vol. 40, p. 1831 (1907) and J. Phya. Chem. Vol. 68, p. 3149.

As silver halide composition of silver halide emulsion in the present invention, any silver halide such as silver bromide, silver iodobromide or silver chloroiodobromide can be used. A preferable silver halide composition of the emulsion is silver iodobromide which contains silver iodide of 5 mol % or less.

Silver halide grains usable in the invention may be ones having any crystal shape such as cubic, octahedral or tetradecahedral single crystal and multiple twin crystal with various shapes.

The silver halide emulsion used in the silver halide light-sensitive photographic material of the present invention can be manufactured by a well-known methods, for example, those described in "Emulsion Preparation and Types" on page 22–23 of Research Disclosure (RD) No. 17643 (December 1978) and described on page 648 of RD No. 18716 (November 1979).

Emulsion usable for silver halide photographic light-sensitive material of present invention can be prepared by the methods, for example, described in T. H. James "The Theory of the Photographic Process" forth edition, pp. 38–104, Macmillan Company (1977); G. D. Duffin "Photographic Emulsion Chemistry" Focal Press (1966); P. Grafkides "Chemie et Physique Photographique" Paul Motel (1967) and V. L. Zelikman et al. "Making and Coating Photographic Emulsion" Focal Press (1964).

Namely, the silver halide emulsion can be produced by a mixing method such as a single-jet mixing method using an acidic, ammoniacal or neutral solution, reverse mixing method or a controlled double-jet mixing method; or by a grain preparation procedure such as a conversion method or core-shell grain formation method; and a method in which the above methods are used in combination.

The silver halide emulsion usable in the present invention can be either so-called a monodispersed emulsion having an narrow grain size distribution, or so-called a polydispersed emulsion which has a wide grain size distribution.

The silver halide may has a crystal structure in which the silver halide composition is different inside and outside of the crystal. For Example, a core/shell type monodispersed emulsion ma be used which is comprised of silver halide grains each has a distinct two-layer structure which is composed of a core having a high silver iodide content and a shell layer having a low iodide content and covering the core.

As a preferable embodiment of the emulsion to be usable in the photographic material of the invention, a monodispersed emulsion comprising silver halide grains in each of which silver iodide is locally distributed. The term of "monodispersed" represent a grains distribution in which silver halide grains each having a size within the range of ±40%, preferably ±30%, of average grain size occupy 95 or more of the whole grains in number or in weight, provided that the grain size is measured by an ordinary method.

The producing method of the above-mentioned monodispersed emulsion is well-known and described, for instance, in J. Phot. Sci., 12, 242–251 (1963), Japanese Patent O.P.I. Publication Nos. 48-36890 (1973), 52- 16364 (1977), 55–142329 (1980) and 58-49983 (1983); British Patent No. 1,413,748, U.S. Pat. Nos. 3,574,628 and 3,655,394.

In the photographic material of the invention, a monodispersed emulsion prepared by a method in which, for instance, seed crystals are used and the seed crystals, functioning as a nucleus, are grown by supplying silver ions and the halide ions to form a monodispersed grains.

The producing method of the above-mentioned core/shell type emulsion is well-known, and, for example, J. Phot. Sci, 24,.198 (1976), U.S. Pat. Nos. 2,592,250, 3,505,068, and No. 4,444,877; and Japanese Patent O.P.I. Publication No. 60-143331(1985) can be referred to.

A tabular grain emulsion comprised of tabular silver halide grains having an average aspect ratio of 2.0 or more is usable in anther preferable embodiment of the photogrpahic materila of the invention. The aspect ratio is more preferably within the rnge of 3 to 10. The average aspect ratio is a ratio of the average diameter of tabular silver halide grains to the average thickness the grains. The thickness of a tabular grain is a distance between two pararel plane of the grain and the diameter of the grain is represented by the diameter of a circle having an area the as the projection area of grain. The tabular grain emulsion can be prepared by the methods or the like described in U.S. Pat. Nos., 4,434,226, 4,439,520, 4,414,310, 4,425,425, 4,339,215, 4,435,501, 4,386,156, 4,400,463 and 4,414,306.

The above-mentioned emulsion may be either a surface latent image type emulsion in which the latent image is mainly formed on the surface of the grain, or an internal latent image type in which the latent image is mainly formed inside the grain. Farther perhaps, it can be one in which latent image is formed both on the surface and inside the grain.

A cadmium salt, a lead salt, a zinc salt, a thallium salt, an iridium salt or a complex salt thereof, a rhodium salt or a complex salt thereof, an iron salt or a complex salt thereof can be used during the step of physical ripening or the step of grain formation.

In order to remove unnecessary soluble salts from the emulsion, a noodle washing method or flocculation precipitation method can be used. As preferable washing method, for example, a method of using aromatic hydrocarbon-aldehyde resin containing a sulfo group as disclosed in Japanese Examined Patent publication No. 35-16086 (1960); or a method in which Exemplified Compound G-3 or G-8 of Japanese Patent O.P.I. publication No. 2-7037(1990), which is a polymer flocculant, may also be used.

Various photographic additives can be used at any appropriate a step during preparation of the silver halide emulsion to be used in the silver halide photographic light-sensitive material of present invention. The additives can be added at a step of physical ripening or chemical ripening or before or after theses steps. As compound usable in such processes, for instance, ones described in the above-mentioned (RD)

Nos. 17643, 18716 and 308119 (December 1989) can be cited. The kind of the compound described in these three (RD) Research Disclosures and the description places are given below:

| | RD-17643 | | RD-18716 | RD-308119 | |
|---|---|---|---|---|---|
| Additives | Page | Class | Page | Page | Class |
| Chemical sensitize | 23 | III | 648 Right upper | 996 | III |
| Sensitizing dye | 23 | IV | 648–649 | 996–8 | IV A |
| Desensitizing dye | 23 | IV | | 998 | IV B |
| Dyestuff | 25–26 | VIII | 649–650 | 1003 | VIII |
| Development accelerator | 29 | XXI | 648 right upper | | |
| Fog inhibitor and stabilizing agent | 24 | IV | 649 right upper | 1006–7 | VI |
| Whitening agent | 24 | V | | 998 | V |
| Hardener | 26 | X | 651 left | 1004–5 | X |
| Surfactant | 26–27 | XI | 650 right | 1005–6 | XI |
| Plasticizer | 27 | XII | 650 left | 1006 | XII |
| Lubricant | 27 | XII | | | |
| Matting agent | 28 | XVI | 650 right | 1008–9 | XVI |
| Binder | 26 | XXII. | | 1003–4 | IX |
| Support | 28 | XVII. | | 1009 | XVII |

As support used for silver halide photographic light-sensitive material of the invention, ones described in above-mentioned RD can be enumerated. A suitable support is polyethylene terephthalate film. The surface of the support may be provided a subbing layer or treatment with corona discharge of UV irradiation to improve the adhesive property with the coating layer.

Photographic material of the invention can be processed by processing solutions described in above-mentioned RD-17643, XX–XXI, page 1011–1012, and 308119, XX–XXI, page 29–30.

This processing is preferably a B/W processing using a developer having a pH value of 8.5 to 13, particularly 9 to 12, for forming a metal silver image. The processing is usually carried out at a temperature within the range from 18° C. to 50° C., preferably 25° C. to 45° C., more preferably 30° C. to 40° C., and preferably for 3 to 20 seconds, more preferably 5 to 14 seconds.

As developing agents for black-and-white photographic processing, dihydroxybenzenes such as hydroquinone; 3-pyrazolidones such as 1-phenyl-3-pyrazolidone and aminophenols such as N-methyl-p-aminophenol such as N-methyl-p-aminophenol can be used singular or in combination. Well-known additives can be used according to necessity. The additives include, for instance, preservatives, alkaline agent, pH buffers, fog inhibitors, hardeners such as glutaraldehyde which may be contained or not contained, development accelerators, surfactants, antifoaming agents, toning agent, water softener, and dissolution aids and thickeners.

In the fixing solution thiosulfate or thiocyanate is used as fixing agent. The fixing solution may further contain a water-soluble aluminum salt such as aluminum sulfate or potassium alum as a hardener. Other additives such as preservatives, pH adjustment agents, and water softening agents may be further contained in the fixing solution. In the invention, the fixing process is carried out preferably at 10° C. to 50° C., more preferably at 25° C. to 40° C., further preferably at 30° C. to 40° C. The time of fixing process is prefrably 3 to 15 seconds, more preferably 3 to 8 seconds.

In the method of photographic processing of silver halide photographic light-sensitive material relating to the present invention, it is preferable that the processing is completed for a time of less than 45 less, when the processing is carried out by an automatic processor including developing, fixing, washing or stabilizing and drying process. Namely, duration from the time at which the front end of the photographic material to be processed is immersed in the developer to the time at which the front end of the processed photographic material is come out from a drying zone, so called time of so-called Dry to Dry is preferably not less than 15 seconds and less than 45 seconds, more preferably not less than 15 seconds to less than 30 seconds.

EXAMPLES

The present invention is further explained with reference to examples, however, of course, the scope of the present invention is not limited by them.

Example 1

<Preparation of Emulsions A through C>
(preparation for seed emulsion)

Monodispersed cubic silver iodobromide grains having average grain size of 0.3 μm and silver iodide content of 2 mol % were prepared by double-jet mixing method maintaining temperature, pAg and pH of the mixing solution at 60° C., 8 and 2.0, respectively. Thus obtained reaction product was then desalted at 40° C. using an aqueous solution of Demol N, a product of Kao Atlas Co,. Ltd., and an aqueous solution of magnesium sulfate, and redispersed by adding an aqueous gelatin solution to obtain a seed emulsion.

Growth of the grain of the seed emulsion.

The seed emulsion mentioned above is used and the grain was grown as follows. The seed emulsion was dispersed in an aqueous gelatin solution maintained at 40° C., then pH of the emulsion was adjusted at 9.7 using the ammonia water and acetic acid.

To this solution, an ammoniacal silver nitrate aqueous solution and an aqueous solution containing potassium bromide and potassium iodide were added by double-jet mixing method. During addition of the solutions, pAg and pH of the emulsion was controlled at 7.3 and 9.7, respectively, to form a layer of which silver iodide content was 35 mol %. Next, an aqueous solution of ammoniacal silver nitrate and an aqueous solution of potassium bromide were added by the double-jet mixing method. In this process, pAg of the emulsion was maintained at 9.0 until the average grain size was grown up to 95% of the predetermined average grain size, and pH was continuously changed 9.0 to 8.0.

Then, while adjusting pAg at 11.0 and maintaining pH at 8.0, silver halide grain was grown to the predetermined grain size. Then, pH of the emulsion was readjusted at 6.0 using acetic acid, and the silver potential of the emulsion was controlled to be +25 mV using a potassium bromide aqueous solution. Next, sodium salt of 5.5'-dichloro-9-ethyl-3,3'-di(3-sulfopropyl)-oxacarbocyanine anhydride (Dye A) and sodium salt of 5,5'-di-(butoxycarbonyl)-1,1'-diethyl-3,3'-di-(4-sulfobutyl)-benzimidazolo carbocyanine anhydride (Dye B) were added in amounts of 300 mg and 15 mg per mol of silver halide, respectively, as spectral sensitizing dyes.

Subsequently in order to remove surplus salts from the emulsion, precipitation desairing operation was carried out by using above-mentioned, aqueous solutions of Demol N and magnesium sulfate, then to add an aqueous gelatin solution containing 92.2g of ossein gelatin was added and the emulsion was redispersed therein by stirring.

According to the above-mentioned method, monodispersed silver iodobromide emulsions (A), (B) and (C) were prepared, which were each composed of tetradecahedral grains having rounded apexes. Silver iodide content of these emulsions was 2.0 mol %, and the average grain sizes and coefficients of variation of gain distribution (δ/r) were 0.40

82 m and 17%, 0.65 μm and 16%, and 1.00 μm and 16%, respectively.

<Preparation of Emulsions D>

(Preparation of a Sphere-shaped Seed Emulsion)

A spherical monodispersed seed emulsion was prepared according to the method disclosed in Japanese Patent O.P.I. Publication No. 61-6643(1986).

| | |
|---|---|
| Solution A1 | |
| Ossein gelatin | 150 g |
| Potassium bromide. | 53.1 g |
| Potassium iodide | 24 g |
| Add water to make the total volume: | 7.2 l |
| Solution B1 | |
| Silver nitrate | 15000 g |
| Add water to make the total volume | 6 l |
| Solution C1 | |
| Potassium bromide. | 1327 g |
| 1-phenyl-5-mercaptotetrazole (methanol solution) | 1.2 g |
| Add water to make the total volume | 3 l |
| Solution D1 | |
| Ammonia water (28%) | 705 ml |

While agitating Solution A1 violently stirring at 40° C., Solution B1 and Solution C1 were added to Solution A1 by simultaneous double-jet mixing process spending 30 seconds to form nuclei. At this time, pBr was 1.09–1.15.

After 1 minute 30 seconds, Solution D1 was added taking 20 seconds, and the emulsion was subjected to ripening for 5 minutes. The concentrations of potassium bromide and ammonia at the time of the ripening were 0.071 mol/l and 0.63 mol/l, respectively.

The emulsion was adjusted at 6.0 of pH and was desalted and washed immediately after the ripening. It was observed by an electron microscope that this seed emulsion was a mono-dispersed seed emulsion containing sphere-shaped grains of which average grain size was 0.26 μm and the variation coefficient of grain size distribution was 18%.

(preparation of grown emulsion)

Thus obtained spherical seed emulsion was taken out in an amount corresponding to 0.14 mols per mol of silver halide to be contained in the final emulsion, and was dissolved and dispersed in an aqueous gelatin solution sodium polypropyleneoxy-polyethyleneoxy-disuccinate maintained at 60° C. Then dimethylaminoboran was added so that its final content becomes $1\times10^{-5}$ mols per mol of silver of the emulsion to be finally formed. Thereafter an aqueous solutions of silver nitrate and an aqueous solution of potassium bromide and potassium iodide were added by controlled double-jet mixing method so that the final silver iodide content of the emulsion becomes to 0.50 mol %. The addition was made for the period of 43 minutes while maintaining pH, pAg and temperature at 2.0, 8.0 and 65° C., respectively.

During this process the silver potential was controlled so as to maintain +25 mV using aqueous potassium bromide solution. After the addition was completed, spectral sensitizing dyes Dye A and Dye B were added in the amounts of 300 mg and 15 mg per mol of silver, respectively.

Next, for the purpose of removing excess salts from the emulsion, precipitation desalinization was carried out by using the above-mentioned aqueous solutions of Demol N and magnesium sulfate, and then, an aqueous gelatin solution containing 92.2 g of ossein gelatin was added to redisperse the emulsion. Thus Emulsion D containing tabular-shaped silver iodobromide grains was obtained, in which average grain size, average thickness and average aspect ratio of the grains were 1.22 μm, 0.29 μm and 4.2, respectively.

The above-mentioned spectral sensitization dyes, Dye A and Dye B were added individually of obtained Emulsions A through D at 55° C. in amounts of 300 mg and 15 mg pre mol of silver, respectively.

After 10 minutes, appropriate amounts of chloroaurate, sodium thiosulfate and ammonium thiocyanate were added to the emulsion and the emulsion was subjected to chemical ripening. Before completion the ripening for 15 minutes, 0.8 mmol per mol of silver halide of silver iodide fine grains, having an average grain size of 0.05 μm, and at the completion of ripening $3\times10^{-2}$ per mol of silver halide of 4-hydroxy-6-methyl- 1, 3,3a,7-tetrazaindene were added to the emulsion. Then the emulsion was dispersed in an aqueous gelatin solution containing 70 g of gelatin.

Emulsions H was prepared by mixing chemically ripened Emulsions A, B and C in the ratio of 1:6:3 and Emulsion I was prepared by mixing Emulsions A, D and C in the ratio of 1:6:3.

The following additives were added to the obtained emulsion to prepare a emulsion layer coating solution. Moreover, the protective layer coating solution was simultaneously prepared as follows. Coating was carried out on a 180 μm thick blue tinted and subbed polyethylene terephthalate support so that the coating amount of silver and gelatin were 1.9 g/m$^2$ and 2.0 g/m$^2$ for one side, respectively. The amount of colloidal silica was controlled so that the coating amount thereof become the amount given in Table 1. The protective layer was coated so that the gelatin amount was become 1.0 g/m$^2$. The coating was carried out simultaneously on the both sides of the support by a slide hopper type coater with a speed of 80 m per minute. Drying the coated layers was completed for 2 minutes 20 seconds. The amount of the hardener added to the coating solution has been adjusted so that moisture content may become Table 1 description.

Additives used for the emulsion are as follows. Added amount is shown with the amount per mol of silver halide.

| | |
|---|---|
| 1,1-dimethylol-1-bromo-1-nitromethane | 70 mg |
| t-Butyl catechol. | 400 mg |
| Polyvinylpyrrolidone (molecular weight 10,000). | 1.0 g |
| Styrene-maleic acid anhydride copolymer | 2.5 g |
| Nitrophenyl-triphenylphosphonium chloride | 50 mg |
| Ammonium 1,3-dihydroxybenzene-4-sulfonate | 2 g |
| Sodium 2-mercaptobenzimidazolesulfonate | 5 g |
| 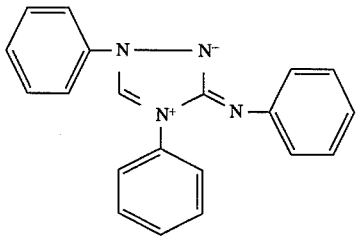 | 60 mg |
| 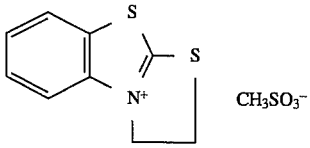 | 35 mg |

-continued

| | |
|---|---|
| $C_4H_9OCH_2CH(OH)CH_2N(CH_2COOH)_2$ | 1 g |
| 1-phenyl-5-mercaptotetrazole. | 15 mg |
| Protective layer solution. | |

Next, the following were prepared as coating solution for the protective layer. Additives are shown with the amount a coating solution liter.

| | |
|---|---|
| Lime-processed inert gelatin | 68 g |
| Sodium i-amyl-n-decylsufosuccinate | 1 g |
| Polymethyl methacrylate (Matting agent, area average size: 7.0 μm) | see Table 1 |
| Hardener | see Table 1 |

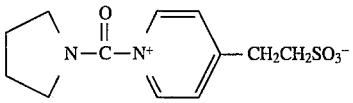

| | |
|---|---|
| $C_4F_9SO_3K$ | 100 mg |
| $C_{12}H_{25}CONH(CH_2CH_2O)_5H$ | 2 g |
| | 1.2 g |

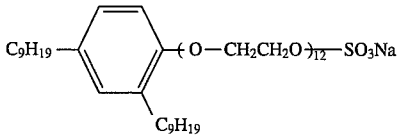

| | |
|---|---|
| | 0.2 g |

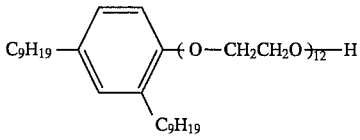

| | |
|---|---|
| $NaO_3S-CHCOOCH_2(C_2F_4)_3H$ / $CH_2COOCH_2(C_2F_4)_3H$ | 0.5 g |
| | 37 mg |

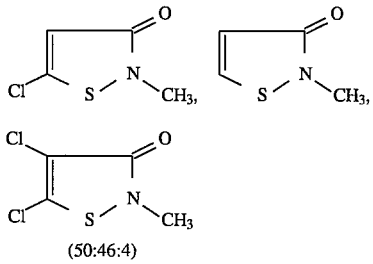

| | |
|---|---|
| $F_{19}C_9O-(CH_2CH_2O)_{10}-CH_2CH_2OH$ | 0.3 g |
| | 1.5 g |

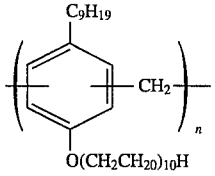

(Mixture of compounds with n = 2 to 5)

Following evaluations were done about thus obtained samples.

(Sensitometry)

A sample was exposed to 3.2 CMS of white light from a light source with no filter according to Standard Light Source B described in "Data book of Illumination" First Edition (second press), p. 39, published by the Society of Illumination. The sensitivity is determined by a reciprocal of light amount necessary for increasing optical density by 1.0, and was shown by relative sensitivity when the sensitivity of sample No. 1 was set as 100.

Processing was carried out under Conditions I, II or III by a processor SRX-502 (Konica Corp.) using a developer and fixer each having the following compositions, respectively. For Conditions II or III, SRX-502 was modified. Namely, the first five of rollers in the drying zone of the processor, which were capable of being cntrolled in there surface temperature, and the other part of the drying zone was remained as a zone in which drying was carried out by heated air at 45° C. The temperature of the heating roller was measured by a thermistor touching to the surface of the roller. The driving mortor and gears of the processor were changed so as to set the processing at 30 seconds or 20 seconds.

Processing step.

| Step | Temp (°C.) | Time (I) (Sec) | Time (II) (Sec) | Time (III) (Sec) | Repl. |
|---|---|---|---|---|---|
| Insert | — | 1.2 | 0.8 | 0.5 | |
| Dev. + co | 35 | 14.6 | 9.7 | 6.5 | 270 ml/m² |
| Fix. + co | 33 | 8.2 | 5.5 | 3.7 | 430 ml/m² |
| Wash + co | 18 | 7.2 | 4.8 | 3.2 | 7.0 l/min |
| Squeeze | 42 | 5.7 | 3.8 | 2.5 | |
| Drying | Table 1 | 8.1 | 5.4 | 3.6 | |
| Totoal | — | 45.0 | 30.0 | 20.0 | |

| | |
|---|---|
| Part-A (for 15 liter finish). | |
| Potassium hydroxide. | 470 g |
| Potassium sulfite (50% solution) | 3000 g |
| Sodium hydrogen carbonate | 150 g |
| Pentasodium diethylenetriaminepentaacetate | 45 g |
| 5-methylbenztriazole. | 2.0 g |
| 1-phenyl-5-mercaptotetrazole | 0.2 g |
| Hydroquinone | 390 g |
| Add water to make the total volume | 5000 ml |
| Part-B (for 15 liter finish) | |
| Glacial acetic acid. | 220 g |
| Triethylene glycol. | 200 g |
| 1-phenyl-3-pyrazolidone. | 27 g |
| 5-nitroindazole | 0.45 g |
| N-acetyl-DL-penicillamin | 0.15 g |
| Starter (for one liter finish) | |
| Glacial acetic acid | 138 g |
| Potassium bromide | 325 g |
| 5-methyl-benztriazole | 1.5 g |
| Add water to make the total volume | 1 liter. |

To 5 liter of water, the above Part A and Part B are added simultaneously and added water while stirring to make that toatal volume to 19 liter. This solution is used as a developer replenisher. On the other hand, a developer solution to be charged to the developing tank of the processor at the starting time of processing is prepared by adding 20 ml of the above starter added to 1 liter of the above developer replenisher.

Recipe of Fixer

| | |
|---|---|
| Part-A (for 19 liter finish). | |
| Ammonium thiosulfate (70 wt/vol %) | 4000 g |
| Sodium sulfite | 175 g |

-continued

| | |
|---|---|
| Sodium acetate trihydrate | 400 g |
| Sodium citrate | 50 g |
| Gluconic acid | 38 g |
| Boric acid | 30 g |
| Glacial acetic acid | 140 g |
| Part-B (for 19 liter finish). | |
| Aluminum sulfate (in terms of anhydride) | 65 g |
| Sulfuric acid (50 wt %) | 105 g |

To 5 liter of water, the above Part A and Part B are added simultaneously and added water while stirring to make that toatal volume to 19 liter. Thus obtained fixing solution is used as both of a fixing solution to be charged in the fixing tank of the processer at the starting time of processing and a fixing replenisher solution.

The moisture content in Table 1 was calculated by weighing the amount of water in the film at the point immediately before drying zone in the above-mentioned processing according the foregoing method.

(Evaluation of Roller Mark)

Roller marks formed on a unexposed sample film processed by the above-mentioned processing method was visually evaluated.

A: There is no pressure mark observed.

B: Non obstacle on practical use though light marks can be found at a near margin part of the film by careful observation C: Non obstacle on practical use though light marks can be found also at a central part of the film D: Overspill of thick spot in near margin part of film which causes obstacle on practical use.

E: A thick spot is scattered in a center part of the film and a near margin part and practical use is impossible.

(Evaluation of Reflection Spot)

The sample exposed so that the density might become 1.0 was developed in the above-mentioned processing. Next, the gloss degree on the surface of the sample was visually observed and the occurrence situation of reflective spot unevenness was evaluated according to a following standard.

A: Occurrence of reflective spot is hardly observed.

B: Non obstacle on practical use though somewhat occurrence is observed

C: A lot of reflective spots are observed and there is an obstacle on practical use D: Occurred in all portion of the film surface (Evaluation of Development Unevenness)

A sample which has developed the above-mentioned processing is visually observed on a film viewer and occurrence situation of development unevenness was evaluated by visual observation according to a following standard.

A: The occurrence of unevenness hardly observed

B: Non obstacle in practical use though occurrence somewhat is observed

C: A lot of density unevenness are observed and there is an obstacle on practical use D: Occurred in all portion of the film surface Thus obtained results are shown in following Table 1.

TABLE 1

| Sample No. | Emulsion used | Emulsion layer: Colloidal silica | Emulsion layer: ($g/m^2$ per side) | Amount of matting agent ($mg/m^2$ per side) | Matting degree | Processing | Heat roller Temp. °C. | Amount of hardener ($mg/m^2$ per side) | Moisture content ($g/m^2$ per side) | Relative sensitivity | Roller mark | Reflective spot unevenness | Development unevenness | Note |
|---|---|---|---|---|---|---|---|---|---|---|---|---|---|---|
| 1 | H | — | — | 14 | 70 | (I) | — | 140 | 7.5 | 100 | D | A | C | Comp. |
| 2 | H | — | — | 14 | 70 | (II) | 95 | 140 | 7.5 | 93 | E | B | D | Comp. |
| 3 | H | — | — | 14 | 70 | (II) | 95 | 200 | 6.5 | 93 | C | D | B | Comp. |
| 4 | H | Snowtex C | 0.20 | 14 | 70 | (II) | 95 | 140 | 7.5 | 95 | E | A | D | Comp. |
| 5 | H | Snowtex C | 0.20 | 14 | 70 | (II) | 95 | 200 | 6.5 | 98 | A | A | A | Inv. |
| 6 | H | Snowtex C | 0.20 | 14 | 70 | (II) | 95 | 250 | 6.0 | 100 | A | A | A | Inv. |
| 7 | H | Snowtex C | 0.20 | 14 | 70 | (II) | 95 | 350 | 5.5 | 100 | A | B | A | Inv. |
| 8 | H | Snowtex C | 0.10 | 14 | 70 | (II) | 95 | 350 | 5.5 | 100 | A | B | B | Inv. |
| 9 | H | Snowtex C | 0.30 | 14 | 70 | (II) | 95 | 350 | 5.5 | 100 | A | B | A | Inv. |
| 10 | H | Snowtex C | 0.30 | 6 | 30 | (II) | 95 | 250 | 6.0 | 100 | A | A | A | Inv. |
| 11 | H | Snowtex C | 0.30 | 28 | 140 | (II) | 95 | 250 | 6.0 | 100 | A | A | B | Inv. |
| 12 | H | Snowtex C | 0.30 | 40 | 200 | (II) | 95 | 250 | 6.0 | 95 | B | C | C | Comp. |
| 13 | I | Snowtex C | 0.20 | 10 | 50 | (II) | 95 | 250 | 6.0 | 100 | A | A | A | Inv. |
| 14 | I | Snowtex 30 | 0.20 | 10 | 50 | (II) | 95 | 250 | 6.0 | 100 | A | A | A | Inv. |
| 15 | I | Snowtex 0 | 0.20 | 10 | 50 | (II) | 95 | 250 | 6.0 | 100 | A | A | A | Inv. |
| 16 | I | Snowtex 20 | 0.20 | 10 | 50 | (II) | 95 | 250 | 6.0 | 100 | A | A | A | Inv. |
| 17 | I | Snowtex 20 | 0.20 | 10 | 50 | (III) | 110 | 250 | 6.0 | 100 | A | A | A | Inv. |
| 18 | I | Snowtex 20 | 0.20 | 10 | 50 | (III) | 110 | 350 | 5.5 | 100 | A | B | A | Inv. |
| 19 | I | — | — | 10 | 50 | (III) | 110 | 350 | 5.5 | 100 | B | D | B | Comp. |

Comp.: Comparative
Inv.: Inventive

As is shown in Table 1, that the samples of the invention give excellent results in which formation of the roller marks is none or very slight and occurrence of the reflective spot and the development unevenness hardly observed. Any deterioration in sensitivity is not occurred in the sample of the invention when the sample is processed by a rapid processing.

What is claimed is:

1. A method for processing an imagewise exposed silver halide photographic light-sensitive material with an automatic processing machine comprising the steps of developing, fixing and washing a photographic light-sensitive material which comprises a support and a photographic layer including a silver halide emulsion layer being provided on said support in which the outermost surface of said photographic layer has a matting degree of 0 to 150 mmHg and said silver halide emulsion layer contains colloidal silica particles, drying said silver halide photographic light-sensitive material by contacting with a heat conductive member having a surface temperature of 90° C. to 150° C. which installed in a drying zone of said automatic processing machine, wherein said photographic light-sensitive material has a moisture content of 3 $g/m^2$ to 6.5 $g/m^2$ at the point just before of said drying zone and the total time from start of said developing process to finish of said drying process is within the range of more than 15 seconds to less than 45 seconds.

2. The method of claim 1, wherein said matting degree of the outermost surface of the photographic layer is 0 to 100 mmHg.

3. The method of claim 1, the surface temperature of said heat conductive member is 90° C. to 130° C.

4. The method of claim 1, wherein the water content of said photographic layer at the point of just before of said drying zone is 4 to 6 $g/m^2$.

5. The method of claim 1, wherein the ratio ($SiO_2$/G) of colloidal silica particles ($SiO_2$) to gelatin (G) in said silver halide emulsion layer is 0.01 to 2.0 by dry weight.

6. The method of claim 1, wherein said silver halide photographic light-sensitive material comprises a support and two photographic layers each including a silver halide emulsion layer and each provided on each surface of said support and each of the photographic layer has a matting degree of 0 to 150 mmHg and water content of 3 $g/m^2$ to 6.5 $g/m^2$ at the point just before of said drying zone.

* * * * *